US010111463B2

(12) United States Patent
Batista

(10) Patent No.: US 10,111,463 B2
(45) Date of Patent: Oct. 30, 2018

(54) COMBUSTIBLE HEAT SOURCE HAVING A BARRIER AFFIXED THERETO AND METHOD OF MANUFACTURE THEREOF

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/122,078

(22) PCT Filed: Feb. 25, 2015

(86) PCT No.: PCT/EP2015/053945
§ 371 (c)(1),
(2) Date: Aug. 26, 2016

(87) PCT Pub. No.: WO2015/128384
PCT Pub. Date: Sep. 3, 2015

(65) Prior Publication Data

US 2017/0055577 A1 Mar. 2, 2017

(30) Foreign Application Priority Data

Feb. 27, 2014 (EP) ..... 14157022

(51) Int. Cl.
*A24F 47/00* (2006.01)
*A24B 15/16* (2006.01)

(52) U.S. Cl.
CPC ..... *A24F 47/004* (2013.01); *A24B 15/165* (2013.01); *A24F 47/006* (2013.01)

(58) Field of Classification Search
CPC ..... A24F 47/004
See application file for complete search history.

(56) References Cited

U.S. PATENT DOCUMENTS 5,040,551 A 8/1991 Schlatter et al.
2014/0376091 A1* 12/2014 Jordan ..... B29D 11/00278 359/567

(Continued)

FOREIGN PATENT DOCUMENTS

CN 1043250 A 6/1990
CN 102762118 A 10/2012

(Continued)

OTHER PUBLICATIONS

International Search Report dated May 19, 2015 in PCT/EP15/053945 Filed Feb. 25, 2015.

(Continued)

*Primary Examiner* — James Harvey
(74) *Attorney, Agent, or Firm* — Oblon, McClelland, Maier & Neustadt, L.L.P.

(57) ABSTRACT

A combustible heat source for a smoking article and a method of manufacturing a combustible heat source are provided. The combustible heat source includes a barrier affixed to an end face of the combustible heat source, wherein a thermally-activated adhesive is provided between the end face and the barrier. The method includes providing a thermally-activatable adhesive between the end face of the combustible heat source and the barrier; affixing the barrier to the end face; and heating the combustible heat source with the barrier affixed to the end face thereof to activate the thermally-activatable adhesive.

14 Claims, 1 Drawing Sheet

(56) References Cited

U.S. PATENT DOCUMENTS

| | | | | |
|---|---|---|---|---|
| 2015/0040924 | A1 | 2/2015 | Mironov et al. | |
| 2015/0107759 | A1 | 4/2015 | Poget et al. | |
| 2015/0335062 | A1* | 11/2015 | Shinkawa | A24F 47/002 131/276 |
| 2017/0055577 | A1* | 3/2017 | Batista | A24F 47/006 |

FOREIGN PATENT DOCUMENTS

| | | | |
|---|---|---|---|
| GB | 2492086 | A | 12/2012 |
| RU | 2 102 906 | C1 | 1/1998 |
| RU | 2 357 623 | C2 | 1/2009 |
| WO | WO 2009/022232 | A2 | 2/2009 |
| WO | WO 2009/074870 | A2 | 6/2009 |
| WO | WO 2012/164077 | A1 | 12/2012 |
| WO | 2013/120855 | A1 | 8/2013 |
| WO | 2013/149810 | A1 | 10/2013 |
| WO | WO 2013/189836 | A1 | 12/2013 |

OTHER PUBLICATIONS

Chinese Office Action with English translation dated Sep. 20, 2017 in corresponding Chinese Patent Application No. 20150007755.7 citing documents AO-AQ therein (pp. 17).

Decision to Grant with English translation and Search Report dated Aug. 29, 2018 in corresponding Russian Patent Application No. 2016138135, (15 pages).

* cited by examiner

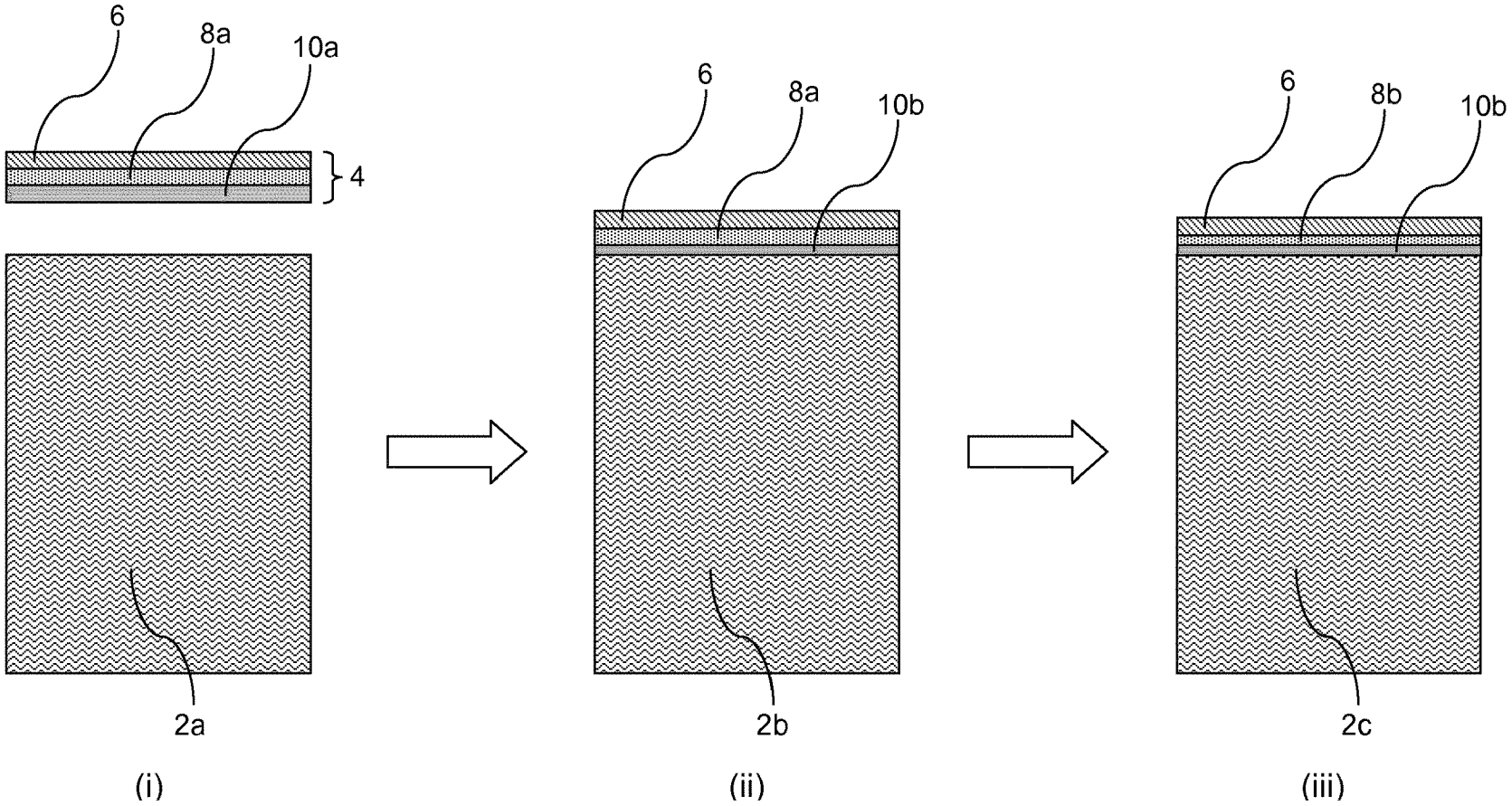
6
8a
10a
4
2a
(i)
6
8a
10b
2b
(ii)
6
8b
10b
2c
(iii)

COMBUSTIBLE HEAT SOURCE HAVING A BARRIER AFFIXED THERETO AND METHOD OF MANUFACTURE THEREOF

CROSS REFERENCE TO RELATED APPLICATION

This application is a U.S. national stage application under 35 U.S.C. § 371 of PCT/EP2015/053945, filed on Feb. 25, 2015, and claims the benefit of priority under 35 U.S.C. § 119 from prior EP Application No. 14157022.6, filed on Feb. 27, 2014, the entire contents of each of which are incorporated herein by reference.

TECHNICAL FIELD

The present invention relates to a combustible heat source for a smoking article having a barrier affixed to an end face thereof and a method of manufacturing a combustible heat source for a smoking article having a barrier affixed to an end face thereof.

DESCRIPTION OF THE RELATED ART

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible carbonaceous heat source. During smoking, volatile compounds are released from the aerosol-forming substrate by heat transfer from the combustible heat source and entrained in air drawn through the smoking article. As the released compounds cool, they condense to form an aerosol that is inhaled by the user.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate.

The combustible heat sources of heated smoking articles may comprise one or more additives to aid ignition or combustion of the combustible heat source. To facilitate aerosol formation, the aerosol-forming substrates of heated smoking articles typically comprise a polyhydric alcohol such as glycerine or other aerosol-former.

In the smoking article disclosed in WO-A2-2009/022232 the front end face of the aerosol-forming substrate is in direct contact with the rear end face of the combustible heat source. However, it is also known to provide heated smoking articles comprising a combustible heat source having a barrier affixed to the rear end face thereof and an aerosol-forming substrate located downstream of the rear end face of the combustible heat source and the barrier.

The barrier may advantageously prevent or inhibit migration of the aerosol-former from the aerosol-forming substrate to the combustible heat source during storage and use of the heated smoking article, and so avoid or reduce decomposition of the aerosol-former during use of the heated smoking article. The barrier may also advantageously limit or prevent migration of other volatile components of the aerosol-forming substrate from the aerosol-forming substrate to the combustible heat source during storage and during use of smoking articles according to the invention.

Alternatively or in addition, the barrier may advantageously limit the temperature to which the aerosol-forming substrate is exposed during ignition or combustion of the combustible heat source, and so help to avoid or reduce thermal degradation or combustion of the aerosol-forming substrate during use of the heated smoking article.

Alternatively or in addition, the barrier may advantageously prevent or inhibit combustion and decomposition products formed during ignition and combustion of the combustible heat source from entering air drawn through the heated smoking article during use thereof. This is particularly advantageous where the combustible heat source comprises one or more additives to aid ignition or combustion of the combustible heat source or a combination thereof.

WO-A1-2013/149810 and WO-A1-2013/189836 describe methods of manufacturing combustible heat sources having a barrier affixed to an end face thereof in which one or more particulate components are compressed in a mould to form the combustible heat source and affix a barrier punched from a laminar barrier material to an end face of the combustible heat source.

Factors such as environmental humidity and vibration and abrasion during manufacturing, transportation and assembly may lead to improper affixment of the barrier to the end face of combustible heat sources manufactured by the methods disclosed in WO-A1-2013/149810 and WO-A1-2013/189836. This may disadvantageously lead to high rates of rejection of combustible heat sources prepared by the methods disclosed in WO-A1-2013/149810 and WO-A1-2013/189836.

It would be desirable to provide a combustible heat source for use in a smoking article that has a barrier securely affixed to the end face thereof. It would also be desirable to provide a method of manufacturing a combustible heat source having a barrier affixed to an end face thereof in which the barrier is reliably affixed to the end face of the combustible heat source.

SUMMARY

According to the invention there is provided a combustible heat source for a smoking article having a barrier affixed to an end face thereof, wherein a thermally-activated adhesive is provided between the end face of the combustible heat source and the barrier.

According to the invention there is also provided a smoking article comprising a combustible heat source having a barrier affixed to an end face thereof and an aerosol-forming substrate downstream of the end face of the combustible heat source and the barrier, wherein a thermally-activated adhesive is provided between the end face of the combustible heat source and the barrier.

According to the invention there is further provided a method of manufacturing a combustible heat source having a barrier affixed to an end face thereof, the method comprising: providing a thermally-activatable adhesive between the end face of the combustible heat source and the barrier; affixing the barrier to the end face of the combustible heat source; and heating the combustible heat source with the barrier affixed to the end face thereof to activate the thermally-activatable adhesive.

BRIEF DESCRIPTION OF THE DRAWINGS

Embodiments will now be further described, by way of example only, with reference to the accompanying drawings in which:

FIGS. 1(*i*)-1(*iii*) show schematic representations of a combustible heat source having a barrier affixed to the end face thereof being manufactured by a method according to the invention.

DETAILED DESCRIPTION

The provision of a thermally-activated adhesive between the end face of the combustible heat source and the barrier advantageously results in more reliable and secure affixment of the barrier to the end face of the combustible heat source. In particular, following activation, the thermally-activated adhesive between the end face of the combustible heat source and the barrier advantageously acts as a glue that adheres the barrier to the end face of the combustible heat source. This advantageously reduces the rate of rejection of combustible heat sources manufactured by the method according to the invention.

The thermally-activated adhesive may be activated during manufacture of the combustible heat source by heating the combustible heat source having the barrier affixed to the end face thereof to a temperature above the activation temperature of the thermally-activated adhesive.

As described further below, in particularly preferred embodiments the thermally-activated adhesive is activated during drying of the combustible heat source having the barrier affixed to the end face thereof. In such embodiments, the thermally activated adhesive preferably has an activation temperature of between about 75° C. and about 95° C.

Suitable thermally-activated adhesives are known in the art and include, but are not limited to, thermoplastic adhesives such as hot-melt adhesives or hot glues. For example, the thermally-activated adhesive may be an ethylene vinyl acetate (EVA) based hot-melt adhesive.

The thermally-activated adhesive is preferably able to withstand the temperatures achieved by the combustible heat source during ignition and combustion thereof. In particular, the thermally-activated adhesive preferably does not release toxic thermal decomposition products at temperatures achieved by the combustible heat source during ignition and combustion thereof.

Preferably, the barrier is non-combustible.

As used herein, the term "non-combustible" is used to describe a barrier that is substantially non-combustible at temperatures reached by the combustible heat source during combustion or ignition thereof.

Preferably, the barrier is substantially air-impermeable. As used herein, the term "substantially air-impermeable" is used to describe a barrier that substantially prevents air from being drawn through the barrier into contact with the combustible heat source.

Depending upon the desired characteristics and performance of the smoking article, the barrier may have a low thermal conductivity or a high thermal conductivity. In certain embodiments, the barrier may be formed from material having a bulk thermal conductivity of between about 0.1 W per meter Kelvin (W/(m·K)) and about 200 W per meter Kelvin (W/(m·K)), at 23° C. and a relative humidity of 50% as measured using the modified transient plane source (MTPS) method.

The thickness of the barrier may be selected to achieve good smoking performance when the combustible heat source having the barrier affixed to the end face thereof is used in a smoking article. In certain embodiments, the barrier may have a thickness of between about 10 microns and about 500 microns. Preferably, the thickness of the barrier is between about 10 microns and about 30 microns, more preferably about 20 microns.

The thickness of the barrier may be measured using a microscope, a scanning electron microscope (SEM) or other suitable measurement methods known in the art.

The barrier may be formed from any suitable material or combination of materials that are substantially thermally stable at temperatures achieved by the combustible heat source during ignition and combustion.

As described further below, preferably the barrier is formed from a laminar barrier material that is capable of being punched to form a barrier.

Preferred materials from which the barrier may be formed include, but are not limited to: copper; aluminium; stainless steel; and alloys. Most preferably, the barrier is formed from aluminium or an aluminium containing alloy. In particularly preferred embodiments, the barrier is formed from >99% pure Aluminium EN AW 1200, or EN AW 8079 alloy.

Preferably, the barrier extends across substantially the entire end face of the combustible heat source.

More preferably, the barrier extends across substantially the entire end face of the combustible heat source and at least partially along an adjacent side of the combustible heat source. In such embodiments, the barrier forms a 'convex cap' that covers the end of the combustible heat source. This advantageously increases the structural rigidity of the periphery of the end face of the combustible heat source covered by the 'cap'. It also advantageously reduces the risk of fragmentation of the combustible heat source along the interface between the barrier and the combustible heat source.

In certain embodiments, the barrier extends along the adjacent side of the combustible heat source for a distance of less than about five times the thickness of the barrier, more preferably less than about three times the thickness of the barrier.

Preferably, a thermally-activatable adhesive is applied to the barrier prior to the barrier being affixed to the end face of the combustible heat source. The thermally-activatable adhesive may be applied to the barrier using any suitable means including, but not limited to, a spray gun, a roller, a slot gun or a combination thereof.

In preferred embodiments, the barrier is formed from a laminar barrier material to which a thermally-activatable adhesive has been pre-applied. In particularly preferred embodiments, the barrier is formed from a laminar barrier material co-laminated with a layer of thermally-activatable adhesive.

A moisture-activated adhesive may be provided between the end face of the combustible heat source and the thermally-activated adhesive. As described further below, this is particularly preferred where combustible heat sources according to the invention are formed by a pressing process.

Following activation thereof, the moisture-activated adhesive between the end face of the combustible heat source and the thermally-activated adhesive advantageously act as a glue that adheres the thermally-activated adhesive to the end face of the combustible heat source. This advantageously reduces the rate of rejection of combustible heat sources manufactured by the method according to the invention.

Preferably, the moisture-activated adhesive is activated prior to heating the combustible heat source having the barrier affixed to the end face thereof to a temperature above the activation temperature of the thermally-activated adhesive.

Suitable moisture-activated adhesives are known in the art and include, but are not limited to, carboxymethyl cellulose (CMC) and water-based adhesives that comprise water as a carrier or diluting medium and that are activated by the evaporation of water or by absorption of water into the substrate. For example, the moisture-activated adhesive may be: a resin cement, such as a water-based emulsion of ethylene vinyl acetate (EVA) or polyvinyl acetate (PVA); a vegetable glue, such as a starch-based or dextrin-based adhesive; a latex or rubber cement (that is, a water-based emulsion of latex or other elastomers); or a protein adhesive, such as an animal, fish or casein glue).

The moisture-activated adhesive is preferably able to withstand the temperatures achieved by the combustible heat source during ignition and combustion thereof. In particular, the moisture-activated adhesive preferably does not release toxic thermal decomposition products at temperatures achieved by the combustible heat source during ignition and combustion thereof.

Preferably, a thermally-activatable adhesive and a moisture-activatable adhesive are applied to the barrier prior to the barrier being affixed to the end face of the combustible heat source. The thermally-activatable adhesive and the moisture-activatable adhesive may be applied to the barrier using any suitable means including, but not limited to, a spray gun, a roller, a slot gun or a combination thereof.

In certain preferred embodiments, the barrier is formed from a laminar barrier material to which a thermally-activatable adhesive and the moisture-activatable adhesive have been pre-applied. In certain particularly preferred embodiments, the barrier is formed from a laminar barrier material co-laminated with a layer of thermally-activatable adhesive and a layer of moisture-activatable adhesive.

Preferably, combustible heat sources according to the invention are combustible carbonaceous heat sources.

As used herein, the term "carbonaceous" is used to describe combustible heat sources, particulate components and particulate materials comprising carbon.

Preferably, combustible carbonaceous heat sources according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term "carbon-based heat source" is used to describe a heat source comprised primarily of carbon.

Combustible carbon-based heat sources for use in smoking articles according to the invention have a carbon content of at least about 50 percent. For example, combustible carbon-based heat sources for use in smoking articles according to the invention may have a carbon content of at least about 60 percent, or at least about 70 percent, or at least about 80 percent by dry weight of the combustible carbon-based heat source.

Combustible carbonaceous heat sources according to the invention may be formed from one or more suitable carbon-containing materials.

One or more binders may be combined with the one or more carbon-containing materials. Combustible heat sources according to the invention may comprise one or more organic binders, one or more inorganic binders or a combination of one or more organic binders and one or more inorganic binders.

Suitable organic binders include but are not limited to: gums, such as, for example, guar gum; modified celluloses and cellulose derivatives such as, for example, methyl cellulose, carboxymethyl cellulose, hydroxypropyl cellulose and hydroxypropyl methylcellulose; flours; starches; sugars; vegetable oils; and combinations thereof.

Suitable inorganic binders include but are not limited to: clays such as, for example, bentonite and kaolinite; alumino-silicate derivatives such as, for example, cement; alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; aluminium compounds and derivatives such as, for example, aluminium sulphate and combinations thereof.

Instead of, or in addition to one or more binders, combustible heat sources according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Preferably, combustible carbonaceous heat sources according to the invention comprise carbon and at least one ignition aid. In certain preferred embodiments, combustible carbonaceous heat sources according to the invention comprise carbon and at least one ignition aid as described in WO-A1-2012/164077.

As used herein, the term "ignition aid" is used to denote a material that releases one or both of energy and oxygen during ignition of the combustible carbonaceous heat source, where the rate of release of one or both of energy and oxygen by the material is not ambient oxygen diffusion limited. In other words, the rate of release of one or both of energy and oxygen by the material during ignition of the combustible carbonaceous heat source is largely independent of the rate at which ambient oxygen can reach the material. As used herein, the term "ignition aid" is also used to denote an elemental metal that releases energy during ignition of the combustible carbonaceous heat source, wherein the ignition temperature of the elemental metal is below about 500° C. and the heat of combustion of the elemental metal is at least about 5 kJ/g.

As used herein, the term "ignition aid" does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of a combustible carbonaceous heat source, such alkali metal burn salts do not release enough energy during ignition of a combustible carbonaceous heat source to produce an acceptable aerosol during early puffs of a smoking article comprising the combustible carbonaceous heat source.

Examples of suitable ignition aids include, but are not limited to: energetic materials that react exothermically with oxygen upon ignition of the combustible carbonaceous heat sources such as, for example, aluminium, iron, magnesium and zirconium; thermites or thermite composites comprising a reducing agent such as, for example, a metal, and an oxidizing agent such as, for example, a metal oxide, that react with one another to release energy upon ignition of the combustible carbonaceous heat source; materials that undergo exothermic reactions upon ignition of the combustible heat source such as, for example, intermetallic and bi-metallic materials, metal carbides and metal hydrides; and oxidizing agents that decompose to release oxygen upon ignition of the combustible carbonaceous heat sources.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulfates; sulfites; other sulfoxides; phosphates; phospinates; phosphites; and phosphanites.

Combustible carbonaceous heat sources according to the invention are preferably formed by mixing one or more carbon-containing materials with one or more binders and any other additives, where included, and forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing Preferably, combustible heat sources according to the invention are formed by a pressing process or an extrusion process. Most preferably, combustible heat sources according to the invention are formed by a pressing process.

Preferably, the mixture of one or more carbon-containing materials, one or more binders and optional other additives is formed into a cylindrical rod. However, it will be appreciated that the mixture of one or more carbon-containing materials, one or more binders and optional other additives may be formed into other desired shapes.

After formation, the cylindrical rod or other desired shape is preferably dried to reduce its moisture content.

Preferably, the thermally-activated adhesive between the barrier and the end face of the combustible heat source is thermally activated during drying of the combustible heat source.

Combustible heat sources according to the invention may comprise a single layer. Alternatively, combustible heat sources according to the invention may be multilayer combustible heat sources comprising a plurality of layers.

As used herein, when used in reference to combustible heat sources according to the invention the terms "layer" and "layers" are used to refer to distinct portions of multilayer combustible heat sources according to the invention that meet one another along interfaces. Use of the terms "layer" and "layers" is not limited to distinct portions of multilayer combustible heat sources according to the invention having any particular absolute or relative dimensions. In particular, layers of multilayer combustible heat sources according to the invention may be laminar or non-laminar.

Preferably, combustible heat sources according to the invention have an apparent density of between about 0.8 $g/cm^3$ and about 1.1 $g/cm^3$.

Preferably, combustible heat sources according to the invention have a mass of between about 300 mg and about 500 mg, more preferably of between about 400 mg and about 450 mg.

Preferably, combustible heat sources according to the invention have a length of between about 7 mm and about 17 mm, more preferably of between about 7 mm and about 15 mm, most preferably of between about 7 mm and about 13 mm.

As used herein, the term "length" denotes the maximum longitudinal dimension of combustible heat sources according to the invention.

Preferably, combustible heat sources according to the invention have a diameter of between about 5 mm and about 9 mm, more preferably of between about 7 mm and about 8 mm.

As used herein, the term "diameter" denotes the maximum transverse dimension of combustible heat sources according to the invention.

Preferably, combustible heat sources according to the invention are of substantially uniform diameter. However, combustible heat sources according to the invention may alternatively be tapered such that the diameter of a first end face of the combustible heat source is greater than the diameter of an opposed second end face thereof. For example, combustible heat sources according to the invention may be tapered such that the diameter of the end face of the combustible heat source to which the barrier is affixed is greater that the diameter of an opposed end face of the combustible heat source.

Preferably, combustible heat sources according to the invention are substantially cylindrical. Cylindrical combustible heat sources according to the invention may be of substantially circular cross-section or of substantially elliptical cross-section.

In particularly preferred embodiments, combustible heat sources according to the invention are substantially cylindrical and of substantially circular cross-section.

Combustible heat sources according to the invention may be non-blind combustible heat sources. As used herein, the term "non-blind" is used to describe a combustible heat source according to the invention having a barrier affixed to an face thereof, wherein at least one aperture is provided in the barrier and wherein the combustible heat source includes at least one airflow channel extending from the end face of the combustible heat source to which the barrier is affixed to an opposed end face of the combustible heat source.

As used herein, the term "airflow channel' is used to describe a channel extending along the length of the combustible heat source. Where combustible heat sources according to the invention are non-blind combustible heat sources, the at least one aperture provided in the barrier affixed to the end face thereof allows air to be drawn along the length of the combustible heat source through the at least one airflow channel for inhalation by a user.

In smoking articles comprising non-blind combustible heat sources according to the invention heating of the aerosol-forming substrate occurs by conduction and forced convection.

The one or more airflow channels may comprise one or more enclosed airflow channels.

As used herein, the term "enclosed" is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

In certain embodiments, non-blind combustible heat sources according to the invention comprise one, two or three airflow channels.

In certain preferred embodiments, non-blind combustible heat sources according to the invention comprise a single airflow channel.

In certain particularly preferred embodiments, non-blind combustible heat sources according to the invention comprise a single substantially central or axial airflow channel. In such embodiments, the diameter of the single airflow channel is preferably between about 1.5 mm and about 3 mm.

It will be appreciated that in addition to one or more airflow channels through which air may be drawn for inhalation by a user, non-blind combustible heat sources according to the invention may comprise one or more closed or blocked air passageways or airflow channels through which air may not be drawn for inhalation by a user.

For example, non-blind combustible heat sources according to the invention may comprise one or more airflow channels extending from the end face of the combustible heat source to which the barrier is affixed to an opposed end face of the combustible heat source through which air may be drawn for inhalation by a user and one or more closed air passageways that extend only part way along the length of the combustible heat source from the end face of the combustible heat source opposed to the end face of the combustible heat source to which the barrier is affixed through which air may not be drawn for inhalation by a user.

The inclusion of one or more closed or blocked air passageways or airflow channels increases the surface area of the non-blind combustible heat source that is exposed to oxygen from the air and may advantageously facilitate ignition and sustained combustion of the non-blind combustible heat source.

Smoking articles according to the invention comprising a non-blind combustible heat source may further comprise a second barrier between the non-blind combustible heat source and the one or more airflow channels through which air may be drawn for inhalation by a user.

The second barrier between the non-blind combustible heat source and the one or more airflow channels through which air may be drawn for inhalation by a user may advantageously substantially prevent or inhibit combustion and decomposition products formed during ignition and combustion of the non-blind combustible heat source from entering air drawn into a smoking article comprising the non-blind combustible heat source through the one or more airflow channels as the drawn air passes through the one or more airflow channels.

Inclusion of a second barrier between the non-blind combustible heat source and the one or more airflow channels through which air may be drawn for inhalation by a user may also advantageously substantially prevent or inhibit activation of combustion of the non-blind combustible heat source during puffing by a user. This may substantially prevent or inhibit spikes in the temperature of the aerosol-forming substrate of a smoking article comprising the non-blind combustible heat source during puffing by a user.

By preventing or inhibiting activation of combustion of the non-blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

Preferably, the second barrier is non-combustible.

Preferably, the second barrier is substantially air-impermeable.

The second barrier may be adhered or otherwise affixed to the non-blind combustible heat source.

In certain preferred embodiments, the second barrier comprises a non-combustible, substantially air impermeable second barrier coating provided on an inner surface of the one or more airflow channels through which air may be drawn for inhalation by a user. In such embodiments, preferably the second barrier comprises a second barrier coating provided on at least substantially the entire inner surface of the one or more airflow channels. More preferably, the second barrier comprises a second barrier coating provided on the entire inner surface of the one or more airflow channels.

As used herein, the term "coating" is used to describe a layer of material that covers and is adhered to the combustible heat source.

In other embodiments, the second barrier may be provided by insertion of a liner into the one or more airflow channels through which air may be drawn for inhalation by a user. For example, where the one or more airflow channels through which air may be drawn for inhalation by a user comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the second barrier may have a low thermal conductivity or a high thermal conductivity. Preferably, the second barrier has a low thermal conductivity.

The thickness of the second barrier may be appropriately adjusted to achieve good smoking performance. In certain embodiments, the second barrier may have a thickness of between about 30 microns and about 200 microns. In a preferred embodiment, the second barrier has a thickness of between about 30 microns and about 100 microns.

The second barrier may be formed from one or more suitable materials that are substantially thermally stable and non-combustible at temperatures achieved by the non-blind combustible heat source during ignition and combustion thereof. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where the second barrier comprises a second barrier coating provided on an inner surface of the one or more airflow channels through which air may be drawn for inhalation by a user, the second barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the second barrier coating. In certain preferred embodiments, the second barrier coating is applied to the inner surface of the one or more airflow channels by the process described in WO-A2-2009/074870 as the combustible heat source is extruded.

Combustible heat sources according to the invention may be blind combustible heat sources. As used herein, the term "blind" is used to describe a combustible heat source according to the invention that does not include any airflow channels extending from the end face of the combustible heat source to which the barrier is affixed to an opposed end face of the combustible heat source. As used herein, the term "blind" is also used to describe a combustible heat source according to the invention including one or more airflow channels extending from the end face of the combustible heat source to which the barrier is affixed to an opposed end face of the combustible heat source, wherein the barrier affixed to the end face of the combustible heat source prevents air from being drawn along the length of the combustible heat source through the one or more airflow channels.

In smoking articles comprising blind combustible heat sources according to the invention heat transfer from the blind combustible heat source to the aerosol-forming substrate occurs primarily by conduction and heating of the aerosol-forming substrate by forced convection is minimised or reduced.

In such embodiments, in use air drawn through the smoking article for inhalation by a user does not pass through any airflow channels along the length of the blind combustible heat source. The lack of any airflow channels along the length of the blind combustible heat source through which air may be drawn for inhalation by a user advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through the smoking article during use thereof.

It will be appreciated that blind combustible heat sources according to the invention may comprise one or more closed or blocked air passageways or airflow channels through which air may not be drawn for inhalation by a user.

For example, blind combustible heat sources according to the invention may comprise one or more closed air passageways that extend only part way along the length of the blind combustible heat source from the end face of the combustible heat source opposed to the end face of the combustible heat source to which the barrier is affixed.

The inclusion of one or more closed or blocked air passageways or airflow channels increases the surface area of the blind combustible heat source that is exposed to oxygen from the air and may advantageously facilitate ignition and sustained combustion of the blind combustible heat source.

Smoking articles according to the invention comprise a combustible heat source with opposed front and rear faces having a barrier affixed to the rear face thereof and an aerosol-forming substrate downstream of the rear end face of the combustible heat source and the barrier, wherein a thermally-activated adhesive is provided between the rear face of the combustible heat source and the barrier.

As used herein, the terms "distal", "upstream" and "front', and "proximal", "downstream" and "rear", are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end of the smoking article. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front face of the combustible heat source is at the upstream end of the combustible heat source. The upstream end of the combustible heat source is the end of the combustible heat source furthest from the proximal end of the smoking article. The rear face of the combustible heat source is at the downstream end of the combustible heat source. The downstream end of the combustible heat source is the end of the combustible heat source closest to the proximal end of the smoking article.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including any wrapper is considered to be the aerosol-forming substrate.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm. In certain embodiments, the aerosol-forming substrate may have a length of between about 6 mm and about 15 mm or a length of between about 7 mm and about 12 mm.

In preferred embodiments, the aerosol-forming substrate comprises a plug of tobacco-based material wrapped in a plug wrap. In particularly preferred embodiments, the aerosol-forming substrate comprises a plug of homogenised tobacco-based material wrapped in a plug wrap.

Smoking articles according to the invention may comprise one or more first air inlets around the periphery of the aerosol-forming substrate.

In such embodiments, in use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

In such embodiments, during puffing by a user the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein, the term "cool air" is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of smoking articles according to the invention.

The number, shape, size and location of the first air inlets may be appropriately adjusted to achieve a good smoking performance.

In certain embodiments, the aerosol-forming substrate may abut the barrier affixed to the rear face of the combustible heat source.

As used herein, the term "abut" is used to describe the aerosol-forming substrate being in direct contact with the barrier affixed to the rear face of the combustible heat source.

In other embodiments, the aerosol-forming substrate may be spaced apart from the barrier affixed to the rear face of the combustible heat source. That is, there may be a space or gap between the aerosol-forming substrate and the barrier affixed to the rear face of the combustible heat source.

In such embodiments, alternatively or in addition to one for more first air inlets around the periphery of the aerosol-forming substrate, smoking articles according to the invention may comprise one or more second air inlets between the rear face of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the smoking article from the space between the combustible heat source and the aerosol-forming substrate and exits the smoking article through the proximal end thereof.

In such embodiments, during puffing by a user cool air drawn through the one or more second inlets between the rear face of the combustible heat source and the aerosol-forming substrate may advantageously reduce the temperature of the aerosol-forming substrate of smoking articles according to the invention. This may advantageously substantially prevent or inhibit spikes in the temperature of the aerosol-forming substrate of smoking articles according to the invention during puffing by a user.

Alternatively or in addition to one or both of one or more first air inlets around the periphery of the aerosol-forming substrate and one or more second inlets between the rear face of the combustible heat source and the aerosol-forming substrate, smoking articles according to the invention may further comprise one or more third air inlets downstream of the aerosol-forming substrate.

Preferably, smoking articles according to the invention further comprise one or more heat-conducting elements around at least a rear portion of the combustible heat source and at least a front portion of the aerosol-forming substrate. The one or more heat-conducting elements are preferably combustion resistant. In certain embodiments, the one or more heat conducting element may be oxygen restricting. In other words, the one or more heat-conducting elements may inhibit or resist the passage of oxygen through the heat-conducting element to the combustible heat source.

Smoking articles according to the invention may comprise a heat-conducting element in direct contact with both at least a rear portion of the combustible heat source and at least a front portion of the aerosol-forming substrate. In such embodiments, the heat-conducting element provides a thermal link between the combustible heat source and the aerosol-forming substrate of smoking articles according to the invention.

Alternatively or in addition, smoking articles according to the invention may comprise a heat-conducting element spaced apart from one or both of the combustible heat source and the aerosol-forming substrate, such that there is no direct contact between the heat-conducting element and one or both of the combustible heat source and the aerosol-forming substrate.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Smoking articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of smoking articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, air drawn into the smoking article passes through the at least one open-ended tubular hollow body as it passes downstream through the smoking article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Preferably, smoking articles according to the invention comprise an outer wrapper that circumscribes the aerosol-forming substrate and at least a rear portion of the combustible heat source. The outer wrapper should grip the combustible heat source and the aerosol-forming substrate of the smoking article when the smoking article is assembled.

More preferably, smoking articles according to the invention comprise an outer wrapper that circumscribes the aerosol-forming substrate, at least a rear portion of the combustible heat source and any other components of the smoking article downstream of the aerosol-forming substrate.

Smoking articles according to the invention may comprise outer wrappers formed from any suitable material or combination of materials. Suitable materials are well known in the art and include, but are not limited to, cigarette paper.

Smoking articles according to the invention may be assembled using known methods and machinery.

The method of manufacturing a combustible heat source having a barrier affixed to an end face thereof according to the invention comprises: providing a thermally-activatable adhesive between the end face of the combustible heat source and the barrier; affixing the barrier to the end face of the combustible heat source; and heating the combustible heat source with the barrier affixed to the end face thereof to activate the thermally-activatable adhesive.

Preferably, the method comprises heating the combustible heat source with the barrier affixed to the end face thereof to a temperature of between about 75° C. and about 95° C. to activate the thermally-activatable adhesive.

More preferably, the method comprises heating the combustible heat source with the barrier affixed to the end face thereof to a temperature of between about 75° C. and about 95° C. in an oven to dry the combustible heat source and activate the thermally-activatable adhesive.

In certain preferred embodiments, the method comprises: providing a mould defining a cavity having a first opening; placing one or more particulate components in the cavity through the first opening; covering the first opening with a laminar barrier material; providing a thermally-activatable adhesive between the one or more particulate components and the laminar barrier material; punching a barrier from the laminar barrier material and compressing the one or more particulate components to form the combustible heat source and affix the barrier to the end face of the combustible heat source by inserting a first punch into the cavity through the first opening; ejecting the combustible heat source having the barrier affixed to the end face thereof from the mould; and heating the combustible heat source with the barrier affixed to the end face thereof to activate the thermally-activatable adhesive.

In other preferred embodiments, the method comprises: providing a mould defining a cavity having a first opening and an opposed second opening; covering the first opening with a laminar barrier material; punching the barrier from the laminar barrier material by inserting a first punch into the cavity through the first opening; placing one or more particulate components in the cavity through the second opening; providing a thermally-activatable adhesive between the one or more particulate components and the barrier; compressing the one or more particulate components to form the combustible heat source and affix the barrier to the end face of the combustible heat source by inserting a second punch into the cavity through the second opening; ejecting the combustible heat source having the barrier affixed to the end face thereof from the mould; and heating the combustible heat source with the barrier affixed to the end face thereof to activate the thermally-activatable adhesive.

As used herein, the term "particulate component" is used to describe any flowable particulate material or combination of particulate materials including, but not limited to, powders and granules. Particulate components used in methods according to the invention may comprise two or more particulate materials of different types. Alternatively or in addition, particulate components used in methods according to the invention may comprise two or more particulate materials of different composition.

As used herein, the term "different composition" is used to refer to materials or components formed from different compounds, or from a different combination of compounds, or from a different formulation of the same combination of compounds.

In certain preferred embodiments, the first punch has a concave profile. The use of a first punch having a concave profile may help to form rounded or truncated edges about the periphery of the end face of the combustible heat source to which the barrier is affixed.

Use of a first punch having a concave profile advantageously may reduce the risk of formation of an air lock between the barrier and the end face of the combustible heat source to which the barrier is affixed. Use of a first punch having a concave profile also advantageously helps the barrier to form a convex cap that covers the end of the combustible heat source.

Where the method according to the invention comprises: punching a barrier from the laminar barrier material and compressing the one or more particulate components to form the combustible heat source and affix the barrier to the end face of the combustible heat source by inserting a first punch into the cavity through the first opening, the use of a first punch having a concave profile may also advantageously reduce friction between the first punch and the mould by substantially preventing the build-up of particulate material between the first punch and the mould; in effect, the first punch acts as a scraper.

In embodiments where the first punch has a concave profile, the first punch may have a concave profile having a depth of between about 0.25 mm and about 1 mm, more preferably of between about 0.4 mm and about 0.6 mm.

In embodiments where the first punch has a concave profile, the first punch may have a concave profile having a chamfered edge at an angle of between about 30 degrees and about 80 degrees.

In other embodiments, the first punch has a flat profile.

Where the method according to the invention comprises: compressing the one or more particulate components to form the combustible heat source and affix the barrier to the end face of the combustible heat source by inserting a second punch into the cavity through the second opening, the profile of the first punch and the second punch may be the same or different.

In certain preferred embodiments, the second punch has a concave profile. In such embodiments, the use of a second punch having a concave profile may help to form rounded or truncated edges about the periphery of an end face of the combustible heat source opposed to the face of the combustible heat source to which the barrier is affixed.

The use of a second punch having a concave profile may also advantageously reduce friction between the second punch and the mould by substantially preventing the build-up of particulate material between the second punch and the mould; in effect, the second punch acts as a scraper.

In embodiments where the second punch has a concave profile, the second punch may have a concave profile having a depth of between about 0.25 mm and about 1 mm, more preferably of between about 0.4 mm and about 0.6 mm.

In embodiments where the second punch has a concave profile, the second punch may have a concave profile having a chamfered edge at an angle of between about 30 degrees and about 80 degrees.

Preferably, the cavity, the first punch, and, where included, the second punch are cylindrical and of corresponding substantially circular cross-section. Alternatively, the cavity, the first punch, and, where included, the second punch may be cylindrical and of corresponding substantially elliptical cross-section.

Where the method according to the invention comprises: punching a barrier from the laminar barrier material and compressing the one or more particulate components to form the combustible heat source and affix the barrier to the end face of the combustible heat source by inserting a first punch into the cavity through the first opening, preferably the first punch is an upper punch. In such embodiments, the barrier is punched from the laminar barrier material by inserting the first punch downwardly into the cavity through the first opening, which is located at an upper end of the mould.

Where the method according to the invention comprises: punching a barrier from the laminar barrier material and compressing the one or more particulate components to form the combustible heat source and affix the barrier to the end face of the combustible heat source by inserting a first punch into the cavity through the first opening, preferably the method comprises ejecting the manufactured combustible heat source having the barrier affixed to the end face thereof from the mould through the first opening.

In certain embodiments, the method may comprise ejecting the manufactured combustible heat source having the barrier affixed to the end face thereof from the mould through the first opening by removing the first punch from the mould through the first opening and moving the moving the mould in a direction substantially opposite to the direction in which the first punch is removed from the mould.

Where the method according to the invention comprises: punching the barrier from the laminar barrier material by inserting a first punch into the cavity through the first opening; and affixing the barrier to the end face of the combustible heat source by inserting a second punch into the cavity through the second opening, preferably the first punch is a lower punch and the second punch is an upper punch. In such embodiments, the barrier is punched from the laminar barrier material by inserting the first punch upwardly into the cavity through the first opening, which is located at a lower end of the mould. The one or more particulate components are then compressed to form the combustible heat source and affix the barrier to the end face of the combustible heat source by inserting the second punch downwardly into the cavity through the second opening, which is located at an upper end of the mould.

Where the method according to the invention comprises compressing the one or more particulate components to form the combustible heat source and affix the barrier to the end face of the combustible heat source by inserting a second punch into the cavity through the second opening, preferably the method comprises ejecting the manufactured combustible heat source having the barrier affixed to the end face thereof from the mould through the second opening.

In certain embodiments, the method may comprise ejecting the manufactured combustible heat source having the barrier affixed to the end face thereof from the mould through the second opening by removing the second punch from the mould through the second opening and moving the first punch within the mould towards the second opening.

Where the first punch is a lower punch and the second punch is an upper punch, preferably the method comprises ejecting the manufactured combustible heat source having the barrier affixed to the end face thereof from the mould through the second opening located at the upper end of the mould by removing the upper punch from the mould through the second opening and moving the lower punch upwardly within the mould towards the second opening.

In other embodiments, the method may comprise ejecting the manufactured combustible heat source having the barrier affixed to the end face thereof from the mould through the second opening by removing the second punch from the mould through the second opening and moving the mould towards the first punch.

Preferably, the method comprises placing the one or particulate components in the cavity using a gravity fed hopper. In certain embodiments, the method comprises advancing the hopper over the first opening or, where included, the second opening of the cavity in order to place the one or more particulate components in the cavity and then retracting the hopper from the first opening or second opening of the cavity.

In certain embodiments, the method may comprise using the hopper to remove a previously manufactured combustible heat source having a barrier affixed to the end face thereof that has been ejected from the mould during the step of advancing the hopper over the first opening or, where included, the second opening of the cavity.

In certain embodiments, the hopper may comprise an outlet for dispensing the one or more particulate components that is substantially sealed against the mould until the outlet is over the first opening or, where included, the second opening of the cavity.

As used herein, the term "sealed" is used to mean that particulate matter contained in the hopper is prevented from exiting the hopper through the outlet.

Preferably, the method comprises covering the first opening with a continuous laminar barrier material. Preferably, the continuous laminar barrier material has a width of between about 1.5 times and about 3 times the width of the cavity.

In order to cover the first opening with the continuous laminar barrier material, the method may comprise feeding the continuous laminar material in a direction substantially parallel to the direction in which the hopper is advanced and retracted.

However, the method may comprise feeding the continuous laminar material in a direction substantially perpendicular to the direction in which the hopper is advanced and retracted.

Preferably, the method comprises restraining the laminar barrier material adjacent the mould during the step of punching the laminar barrier material. This advantageously improves the quality of the barrier formed by punching the laminar barrier material.

Preferably, the step of restraining the laminar barrier material comprises using a plate, which comprises a through hole for receiving the first punch, to press the laminar barrier material against the mould adjacent the first opening or, where included, the second opening of the cavity.

To allow the simultaneous manufacture of multiple combustible heat sources having barriers affixed to the end faces thereof, the method may comprise providing a plurality of moulds each provided with a corresponding first punch and, where included, a corresponding second punch.

The plurality of moulds may be provided in a single row or in multiple rows.

Alternatively, the method of the invention may be carried out using a continuously rotating multi-cavity or so-called 'turret press'. In such embodiments, multiple moulds are rotated about a central axis and one or more particulate components are placed into the cavities of the moulds through the first openings or, where included, the second openings thereof using a hopper. The laminar barrier material is then provided, adjacent the mould, to cover the first opening or, where included, the second opening of the cavity, the laminar barrier material being fed substantially tangentially to the rotating multi-cavity press. The first punch is provided vertically above or below the laminar barrier material, and during the step of punching the laminar barrier material, the first punch is angularly stationary relative to the mould into which it is being inserted.

Preferably, the thermally-activatable adhesive is applied to the laminar barrier material prior to covering the first opening with the laminar barrier material. The thermally-activatable adhesive may be applied to the laminar barrier material using any suitable means including, but not limited to, a spray gun, a roller, a slot gun or a combination thereof.

In preferred embodiments, the method according to the invention comprises covering the first opening with a laminar barrier material to which the thermally-activatable adhesive has been pre-applied. In particularly preferred embodiments, the method according to the invention comprises covering the first opening with a laminar barrier material co-laminated with a layer of the thermally-activatable adhesive.

Preferably, the method according to the invention further comprises providing a moisture-activatable adhesive between the end face of the combustible heat source and the thermally-activatable adhesive.

Where the method according to the invention comprises compressing one or more particulate components to form the combustible heat source and affix the barrier to the end face of the combustible heat source, preferably the method according to the invention further comprises providing a moisture-activatable adhesive between the one or more particulate components and the thermally-activated adhesive.

In such embodiments, compressing the one or more particulate components to form the combustible heat source and affix the barrier to the end face of the combustible heat source increases the moisture level per volume of the one or more particulate components. The increase in moisture level per volume at the end face of the combustible heat source advantageously activates the moisture-activatable adhesive provided between the thermally-activatable adhesive and the one or more particulate components. In other words, in such embodiments, the method according to the inventions comprises: compressing the one or more particulate components to form the combustible heat source, affix the barrier to the end face of the combustible heat source and activate the moisture-activatable adhesive.

Preferably, the thermally-activatable adhesive and the moisture-activatable adhesive are applied to the laminar barrier material prior to covering the first opening with the laminar barrier material. The thermally-activatable adhesive and the moisture-activatable adhesive may be applied to the laminar barrier material using any suitable means including, but not limited to, a spray gun, a roller, a slot gun or a combination thereof.

In preferred embodiments, the method according to the invention comprises covering the first opening with a laminar barrier material to which the thermally-activatable adhesive and the moisture-activatable adhesive have been pre-applied. In particularly preferred embodiments, the method according to the invention comprises covering the first opening with a laminar barrier material co-laminated with a layer of the thermally-activatable adhesive and a layer of the moisture-activatable adhesive.

The method according to the invention may be used to manufacture combustible carbonaceous heat sources having a barrier affixed to an end face thereof. In such embodiments, at least one of the one or more particulate components placed in the cavity is carbonaceous.

The method according to the invention may comprise placing one or more carbonaceous particulate components in the cavity.

Alternatively or in addition, the method according to the invention may comprise placing one or more non-carbonaceous particulate components in the cavity.

Carbonaceous particulate components for use in the method according to the invention may be formed from one or more suitable carbon-containing materials.

Preferably, at least one of the one or more particulate components comprises a binder.

The one or more particulate components may comprise one or more organic binders, one or more inorganic binders or a combination of one or more organic binders and one or more inorganic binders. In certain embodiments, the one or more binders may help to affix the barrier to the end face of the combustible heat source.

Where methods according to the invention are used to make combustible carbonaceous heat sources, instead of, or in addition to, one or more binders the one or more particulate components may comprise one or more additives in order to improve the properties of the combustible carbonaceous heat source.

Where methods according to the invention are used to make combustible carbonaceous heat sources, preferably at least one of the one or more particulate components comprises an ignition aid. In certain embodiments, at least one of the one or more particulate components may comprise carbon and an ignition aid.

The method according to the invention may be used to manufacture combustible heat sources that are blind or non-blind.

The method according to the invention may be used to manufacture combustible heat sources comprising a single layer. Alternatively, the method according to the invention may be used to manufacture multilayer combustible heat sources comprising a plurality of layers.

For example, to manufacture a bilayer combustible heat source, the method according to the invention may comprise placing a first particulate component and a second particulate component in the cavity and compressing the first particulate component to form a first layer of the bilayer combustible heat source and compressing the second layer to form a second layer of the bilayer combustible heat source.

For the avoidance of doubt, features described above in relation to one aspect of the invention may also be applicable to other aspects of the invention. In particular, features described above in relation to combustible heat sources according to the invention may also relate, where appropriate, to one or both of smoking articles according to the invention and methods of manufacturing combustible heat sources according to the invention, and vice versa.

All scientific and technical terms used herein have meanings commonly used in the art unless otherwise specified. The definitions provided herein are to facilitate understanding of certain terms used frequently herein.

The terms "preferred" and "preferably" refer to embodiments of the invention that may afford certain benefits, under certain circumstances. Particularly preferred are combustible heat sources, smoking articles and methods of manufacturing combustible heat sources according to the invention comprising combinations of preferred features. However, it will be appreciated that other embodiments may also be preferred, under the same or other circumstances. Furthermore, the recitation of one or more preferred embodiments does not imply that other embodiments are not useful, and is not intended to exclude other embodiments from the scope of the claims.

FIG. 1(*iii*) shows a manufactured cylindrical combustible carbonaceous heat source 2*c* of substantially circular cross-section having a non-combustible and substantially air-impermeable barrier 6 affixed to an end face thereof according to the invention. The barrier extends across the entire end face of the combustible heat source 2*c*. Although not shown in FIG. 1(*iii*), in a preferred embodiment the barrier 6 also extends partially along the adjacent side of the combustible heat source 2*c*, forming a 'convex cap' that covers the end of the combustible heat source 2*c*.

As shown in FIG. 1(*iii*) a layer of thermally-activated adhesive 8*b* is provided between the end face of the combustible heat source 2*c* and the barrier 6. As also shown in FIG. 1(*iii*) a layer of moisture-activated adhesive 10*b* is provided between the end face of the combustible heat source 2*c* and the layer of thermally-activated adhesive 8*b*. As shown in FIG. 1(*i*) and described further below, the barrier is formed from a laminar barrier material that is co-laminated with a layer of thermally-activatable adhesive 8*a* and a layer of moisture-activatable adhesive 10*a*. In a preferred embodiment the laminar barrier material is aluminium foil.

The combustible heat source 2*c* having a barrier 6 affixed to an end face thereof shown in FIG. 1(*iii*) is manufactured using a mould defining a cavity having a first opening (not shown). A hopper containing a supply of particulate material comprising one or more carbonaceous particulate components, one or more binders and optionally other additives is provided above the cavity. The hopper is slidably mounted relative to the mould, such that it can reciprocate along a line perpendicular to the longitudinal axis of the cavity, and is configured to deposit particulate material into the cavity via an outlet. A first punch is provided vertically above the cavity and is arranged such that the longitudinal axis of the first punch and the longitudinal axis of the cavity are aligned. The first punch is moveable relative to the cavity in a direction parallel to the longitudinal axes thereof. A bobbin comprising the laminar barrier material co-laminated with the layer of thermally-activatable adhesive 8*a* and the layer of moisture-activatable adhesive 10*a* is provided. The bobbin is configured to deliver the laminar barrier material co-laminated with the layer of thermally-activatable adhesive 8*a* and the layer of moisture-activatable adhesive 10*a* in a direction substantially parallel to the direction that the hopper reciprocates to cover the first opening of the cavity. The laminar barrier material co-laminated with the layer of thermally-activatable adhesive 8*a* and the layer of moisture-activatable adhesive 10*a* is delivered such that the layer of moisture-activatable adhesive 10*a* faces the cavity.

To manufacture the combustible heat source, the hopper is positioned such that the outlet is located over the first opening of the cavity. In this position, the hopper dispenses a supply of the particulate material contained therein into the cavity. A sufficient quantity of the particulate material is dispensed from the hopper into the cavity through the first opening to form a single combustible heat source. The laminar barrier material co-laminated with the layer of thermally-activatable adhesive 8*a* and the layer of moisture-activatable adhesive 10*a* is moved away from the first opening of the cavity by the hopper during filling of the cavity.

Once the hopper has dispensed a sufficient quantity of the particulate material into the cavity it retreats moves away from the first opening of the cavity. As the hopper moves away from the first opening of the cavity, the first punch advances downwardly towards the first opening of the cavity. The barrier 6 is formed by punching the laminar barrier material co-laminated with the layer of thermally-activatable adhesive 8*a* and the layer of moisture-activatable adhesive 10*a* with the first punch. To ensure that the laminar barrier material co-laminated with the layer of thermally-activatable adhesive 8*a* and the layer of moisture-activatable adhesive 10*a* is in the correct position for punching to form the barrier 6, it is restrained by a plate attached to the first punch. As the first punch advances downwardly towards the cavity, the plate engages the laminar barrier material co-laminated with the layer of thermally-activatable adhesive 8*a* and the layer of moisture-activatable adhesive 10*a* and restrains it over the first opening of the cavity. Once it engages the laminar barrier material co-laminated with the layer of thermally-activatable adhesive 8*a* and the layer of moisture-activatable adhesive 10*a*, the plate stops moving relative to the cavity, and the first punch continues to advance downwardly, moving relative to the plate and the cavity. As the first punch enters the cavity through the first opening it punches a barrier 6 from the laminar barrier material co-laminated with the layer of thermally-activatable adhesive 8*a* and the layer of moisture-activatable adhesive 10*a*. The first punch preferably has a concave cross-sectional profile. This facilitates cutting of the laminar barrier material co-laminated with the layer of thermally-activatable adhesive 8*a* and the layer of moisture-activatable adhesive 10*a* by the first punch; in effect, the concave profile provides a knife-like edge to the first punch to enable the laminar barrier material co-laminated with the layer of thermally-activatable adhesive 8*a* and the layer of moisture-activatable adhesive 10*a* to be cut more easily to form the barrier 6.

As the first punch enters the cavity through the first opening it compresses the particulate material 2*a* in the cavity to form the combustible heat source and affix the barrier 6 to the end face of the combustible heat source. The concave cross-sectional profile of the first punch moves the particulate material away from the interface between the first punch and the mould and so reduces friction between the first punch and the mould as the first punch is inserted into the cavity through the first opening; in effect, the concave profile acts as a scraper along the inside of the cavity.

Compression of the particulate material by the first punch to form the combustible heat source and affix the barrier to the end face of the combustible heat source, increases the moisture level per volume of the particulate material. As shown schematically in FIG. 1(*ii*), the increase in moisture level per volume at the end face of the combustible heat source activates the layer of moisture-activatable adhesive 10*a* provided between the layer of thermally-activatable adhesive 8*a* and the one or more particulate components. The resulting layer of moisture-activated adhesive 10*b* adheres the layer of thermally-activatable adhesive 8*a* to the end face of the combustible heat source.

Once the compressing step is complete, the first punch retreats upwardly. As the first punch retreats a portion of the mould defining the walls of the cavity is lowered relative to a portion of the mould defining the base of the cavity. In this way, the combustible heat source with the barrier 6 affixed to the end face thereof is ejected from the cavity. As the portion of the mould defining the side walls of the cavity is lowered, the hopper is advanced towards the first opening of the cavity to begin the process of manufacturing a further combustible heat source. As the hopper advances, the leading edge of the hopper is used to clear the ejected combustible heat source 2*b* with the barrier 6 affixed to the end face thereof from the work area. In this way, a continuous process is provided.

The ejected combustible heat source 2*b* with the barrier 6 affixed to the end face thereof is transferred to an oven where is dried at a temperature of between about 75° C. and about 95° C. for a period of between about 40 minutes and about 50 minutes to reduce the moisture content thereof. As shown schematically in FIG. 1(*iii*), temperatures achieved inside the oven during drying of the ejected combustible heat source 2*b* with the barrier 6 affixed to the end face thereof activate the layer of thermally-activatable adhesive 8*a* between the layer of moisture-activated adhesive 10*b* and the end face of the combustible heat source. The resulting layer of thermally-activated adhesive 8*b* adheres the barrier 6 to the activated layer of moisture-activated adhesive 10*b*. Thus, following the drying step, the barrier 6 is advantageously adhered to the end face of the combustible heat source 2*c* by both a layer of thermally-activated adhesive 8*b* and a layer of moisture-activated adhesive 10*b*.

The specific embodiments and examples described above illustrate but do not limit the invention. It is to be understood that other embodiments of the invention may be made and the specific embodiments and examples described herein are not limiting.

The invention claimed is:

1. A combustible heat source for a smoking article comprising:

a barrier affixed to an end face of the combustible heat source; and a thermally-activated adhesive provided between the end face of the combustible heat source and the barrier, wherein the combustible heat source is a combustible carbonaceous heat source and comprises an ignition aid.

2. The combustible heat source according to claim 1, wherein a moisture-activated adhesive is provided between the end face of the combustible heat source and the thermally-activated adhesive.

3. The combustible heat source according to claim 1, wherein the thermally-activated adhesive has a thermal activation temperature of between about 75° C. and about 95° C.

4. The combustible heat source according to claim 1, wherein the barrier is formed from aluminium or an aluminium containing alloy.

5. A method of manufacturing a combustible heat source, comprising:

providing a thermally-activatable adhesive between an end face of the combustible heat source and a barrier;

affixing the barrier to the end face of the combustible heat source; and heating the combustible heat source with the affixed barrier to activate the thermally-activatable adhesive, wherein the combustible heat source is a combustible carbonaceous heat source and comprises an ignition aid.

6. The combustible heat source according to claim 1, wherein the combustible heat source is formed by a pressing process.

7. A smoking article, comprising a combustible heat source according to claim 1; and an aerosol-forming substrate downstream of the end face of the combustible heat source and of the barrier.

8. The method according to claim 5, further comprising:

providing a mould defining a cavity having a first opening;

placing one or more particulate components in the cavity through the first opening;

covering the first opening with a laminar barrier material;

providing the thermally-activatable adhesive between the one or more particulate components and the laminar barrier material;

punching the barrier from the laminar barrier material and compressing the one or more particulate components to form the combustible heat source;

affixing the barrier to the end face of the combustible heat source by inserting a first punch into the cavity through the first opening;

ejecting the combustible heat source having the affixed barrier from the mould; and heating the combustible heat source with the affixed barrier to activate the thermally-activatable adhesive.

9. The method according to claim 8, further comprising providing a moisture-activatable adhesive between the one or more particulate components and the thermally-activatable adhesive.

10. The method according to claim 5, further comprising:

providing a mould defining a cavity having a first opening and an opposed second opening;

covering the first opening with a laminar barrier material;

punching the barrier from the laminar barrier material by inserting a first punch into the cavity through the first opening;

placing one or more particulate components in the cavity through the second opening;

providing the thermally-activatable adhesive between the one or more particulate components and the barrier;

compressing the one or more particulate components to form the combustible heat source;

affixing the barrier to the end face of the combustible heat source by inserting a second punch into the cavity through the second opening;

ejecting the combustible heat source having the affixed barrier from the mould; and heating the combustible heat source with the affixed barrier to activate the thermally-activatable adhesive.

11. The method according to claim 8, further comprising heating the combustible heat source with the affixed barrier to a temperature of between about 75° C. and about 95° C.

12. The method according to claim 8, wherein the thermally-activatable adhesive is applied to the laminar barrier material prior to covering the first opening with the laminar barrier material.

13. The method according to claim 12, wherein the laminar barrier material is co-laminated with a layer of the thermally-activatable adhesive.

14. The method according to claim 9, wherein the laminar barrier material is co-laminated with a layer of the thermally-activatable adhesive and a layer of the moisture-activatable adhesive.

* * * * *